US005462234A

United States Patent [19]

Patzelt et al.

[11] Patent Number: 5,462,234

[45] Date of Patent: Oct. 31, 1995

[54] GRINDING PLANT AND METHOD OF GRINDING AND CLASSIFYING BRITTLE MATERIAL FOR GRINDING

[75] Inventors: Norbert Patzelt; Gotthard Blasczyk; Hubert Eickholt, all of Beckum, Germany

[73] Assignee: Krupp Polysius AG, Beckum, Germany

[21] Appl. No.: 230,628

[22] Filed: Apr. 21, 1994

[30] Foreign Application Priority Data

Jun. 16, 1993 [DE] Germany ..... 43 20 025.7

[51] Int. Cl.[6] ..... B02C 21/00; B02C 23/12; B02C 23/14; B02C 23/32

[52] U.S. Cl. ..... 241/19; 241/29; 241/76; 241/77; 241/78; 241/79.1; 241/152.2

[58] Field of Search ..... 241/19, 24, 29, 241/76, 77, 78, 79, 79.1, 80, 81, 97, 152.2

[56] References Cited

U.S. PATENT DOCUMENTS

| | | | |
|---|---|---|---|
| 2,980,347 | 4/1961 | Claes | 241/152.2 X |
| 3,982,699 | 9/1976 | Jäger | 241/29 X |
| 4,726,531 | 2/1988 | Strasser | 241/152.2 X |
| 4,889,289 | 12/1989 | Lohnherr et al. | 241/29 X |
| 5,005,770 | 4/1991 | Suessegger | 241/29 X |
| 5,058,813 | 10/1991 | Thomas et al. | 241/29 X |

FOREIGN PATENT DOCUMENTS

| | | | |
|---|---|---|---|
| 413155 | 2/1991 | European Pat. Off. | 241/152.2 |
| 531393 | 2/1993 | Japan | 241/152.2 |

*Primary Examiner*—Timothy V. Eley
*Attorney, Agent, or Firm*—Learman & McCulloch

[57] ABSTRACT

The invention relates to a grinding plant and to a method of grinding and classifying brittle material for grinding, in which two classifiers are used. The finer fraction from the first classifier is delivered to a second classifier which separates it into coarse material and fine material. The coarse material passes into a fine grinding mill and from there is conveyed back to the second classifier by way of a mechanically transporting conveyor arrangement.

9 Claims, 2 Drawing Sheets

GRINDING PLANT AND METHOD OF GRINDING AND CLASSIFYING BRITTLE MATERIAL FOR GRINDING

The invention relates to a grinding plant and to a method of grinding and classifying brittle material for grinding.

BACKGROUND OF THE INVENTION

A grinding plant with two-stage classification is known in the art in which the brittle material for grinding is first of all crushed in a primary mill, particularly a material bed roller mill with two rollers pressed against one another with high pressure, and is delivered to a first classifier. There the crushed material for grinding is classified into a coatset and a finer fraction. Whilst the coatset fraction is returned to the primary mill the finer fraction is conveyed pneumatically into a second classifier arranged overhead. The classification into coarse and fine material takes place there. The coarse material is then ground in a fine grinding mill, particularly a ball mill, and from there is fed into the vertical uptake pipe between the first and second classifiers. From there the material ground in the fine grinding mill is pneumatically conveyed together with the finer fraction from the first classifier into the second classifier. However, the pneumatic conveying of the material to be classified is unfavourable in energy terms.

SUMMARY OF THE INVENTION

This object is achieved according to the invention in that the fine grinding mill and the classifier are connected by way of a conveyor arrangement which mechanically transports the material as far as the second classifier.

The tests on which the invention is based have shown that feeding the recirculated material from the fine, grinding mill directly to the second classifier does not result in any reduction in the classification capacity.

The air for cooling/heating and for transport of the material is delivered by way of an air inlet connection on the first classifier and drawn off by way of an exhaust air connection on the second classifier, so that the entire quantity of air passing through the second classifier first flows through the first classifier. As a result a precipitator and a fan can be dispensed with, and classifiers of equal size can be used, so that on the one hand the energy consumption can be reduced and on the other hand less space is required.

In a particularly advantageous embodiment of the invention the two classifiers, when viewed spat tally, are arranged substantially side by side, the first classifier being provided above the primary mill and the second classifier above the fine grinding mill. In this way a relatively space-saving arrangement of the grinding plant can be achieved.

Further embodiments of the invention are the subject matter of the subordinate claims and are explained in greater some examples.

THE DRAWINGS

FIG. 1 shows a schematic representation of the first embodiment of grinding plant, FIG. 2 shows a schematic representation of a second embodiment and FIG. 3 shows a schematic representation of a third embodiment.

DETAILED DESCRIPTION

Figure 1:
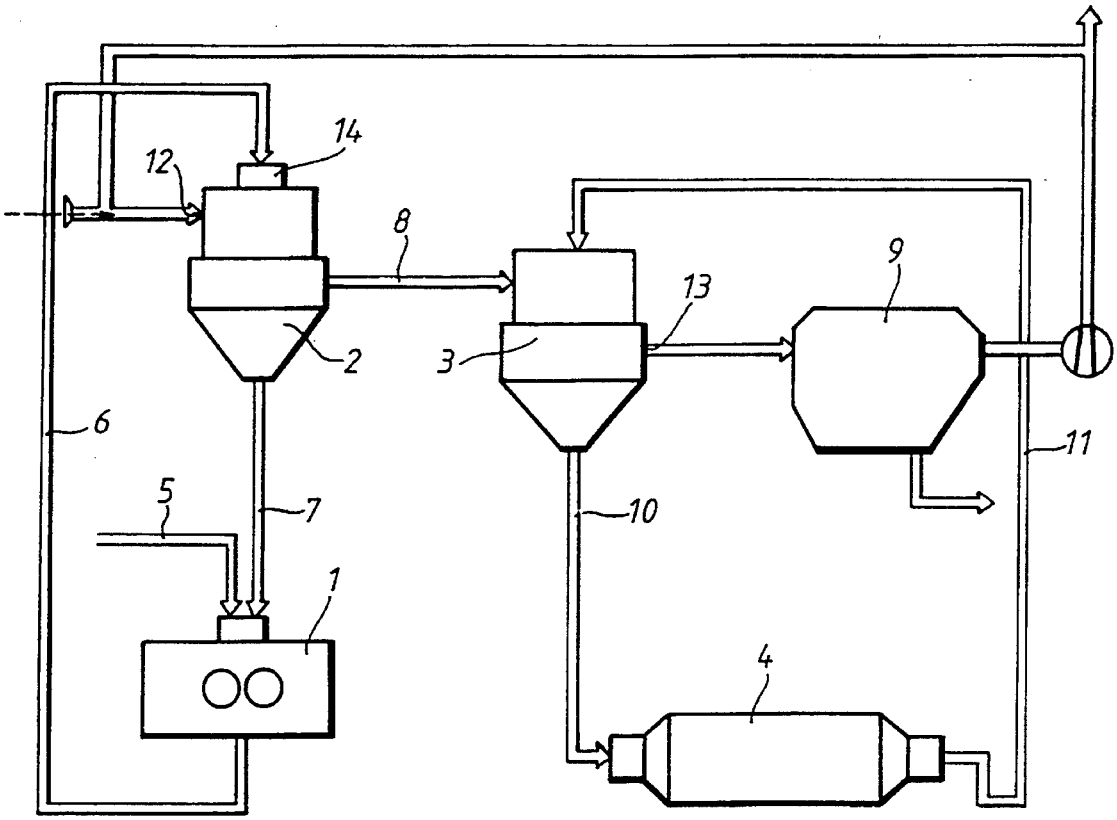

The first embodiment of a grinding plant which is shown in FIG. 1 includes a primary mill 1, which can be formed for example by a material bed roller mill with two rollers pressed against one another with high pressure, a first classifier 2, a second classifier 3 and a fine grinding mill 4 which can for example be formed by a ball mill.

The brittle material which is to be crushed is first of all fed to the primary mill I by way of a duct 5. The crushed material is delivered for example by way of an elevator 6 to the first classifier 2 which has a disagglomerator 14 arranged before it.

In the first classifier 2 the material for grinding is classified into a coarser and a finer fraction. The coarser fraction may be returned to the primary mill 1 by way of a duct which is constructed for example as a chute 7. The finer fraction from the first classifier 2 is delivered to the second classifier 8 and there is separated into coarse material and fine material. The second classifier 3 is constructed as a dynamic air classifier with a distributor plate at the top. Also the first classifier 2 is here provided as a dynamic classifier.

Whereas the fine material is precipitated by way of a filter 9 as finished material, the coarse material passes through a duct 10 into the fine grinding mill 4. The ground material is conveyed by way of a mechanically transporting conveyor arrangement 11, for example an elevator, back to the second classifier. 3. There it is fed to the overhead distributor plate of the second classifier.

The classification and the transport of the material between the first and second classifiers 2, 3 takes place by means of fresh air or hot gases or circulating air. For this purpose an air inlet connection is provided at the point 12 on the first classifier 2 and an exhaust air connection at 13 on the second classifier 3. The entire quantity of air, whether it be fresh air, hot gas or circulating air, first of all flows through the first classifier and then through the second classifier.

In the embodiment according to FIG. 1 the two classifiers 2, 3 are arranged substantially side by side, the first classifier 2 being provided above the primary mill 1 and the second classifier 3 above the fine grinding mill 4. Such an arrangement represents an optimum utilisation of the space available above the two mills.

Figure 2:
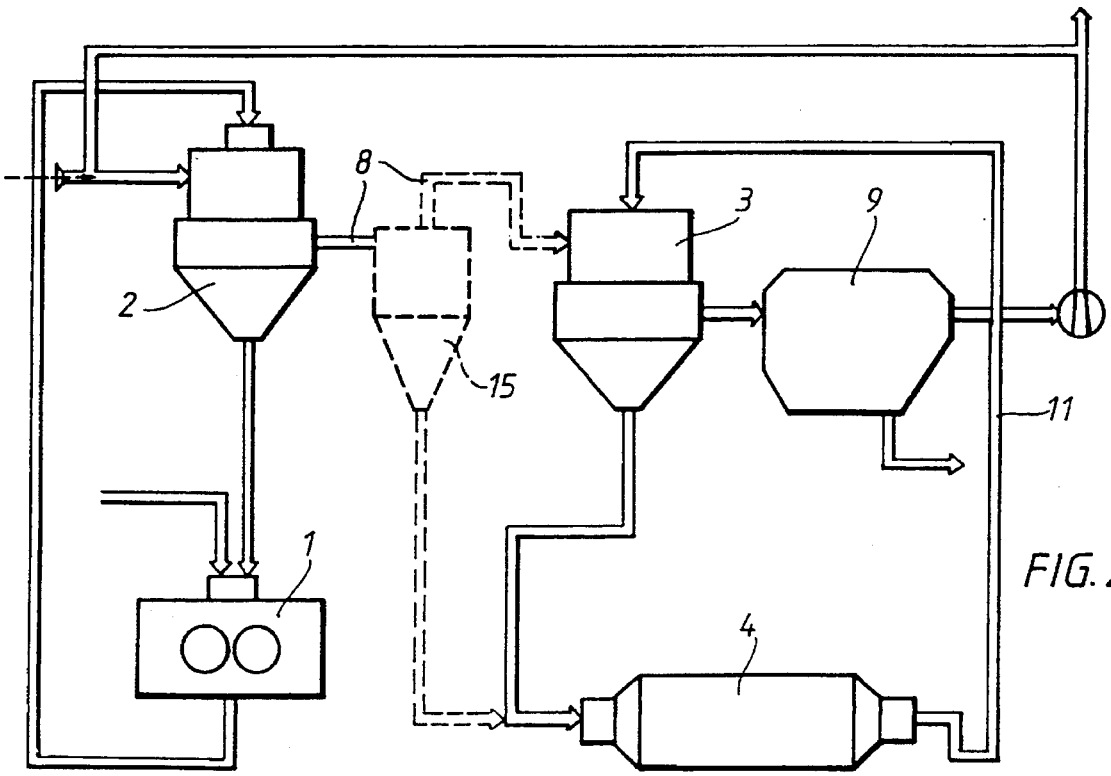

In FIG. 2 a second embodiment of a grinding plant is shown, in which the same reference numerals are used for the same parts of the plant.

The only difference between the two embodiments is that in the second embodiment a cyclone 15 is interposed in the duct 8 between the first and the second classifiers 2, 3. In certain cases it may be necessary on quality grounds for a proportion of the finer fraction from the first classifier to be delivered directly to the fine grinding mill 4. As in the past, the remaining proportion passes first of all into the second classifier 3.

Figure 3:
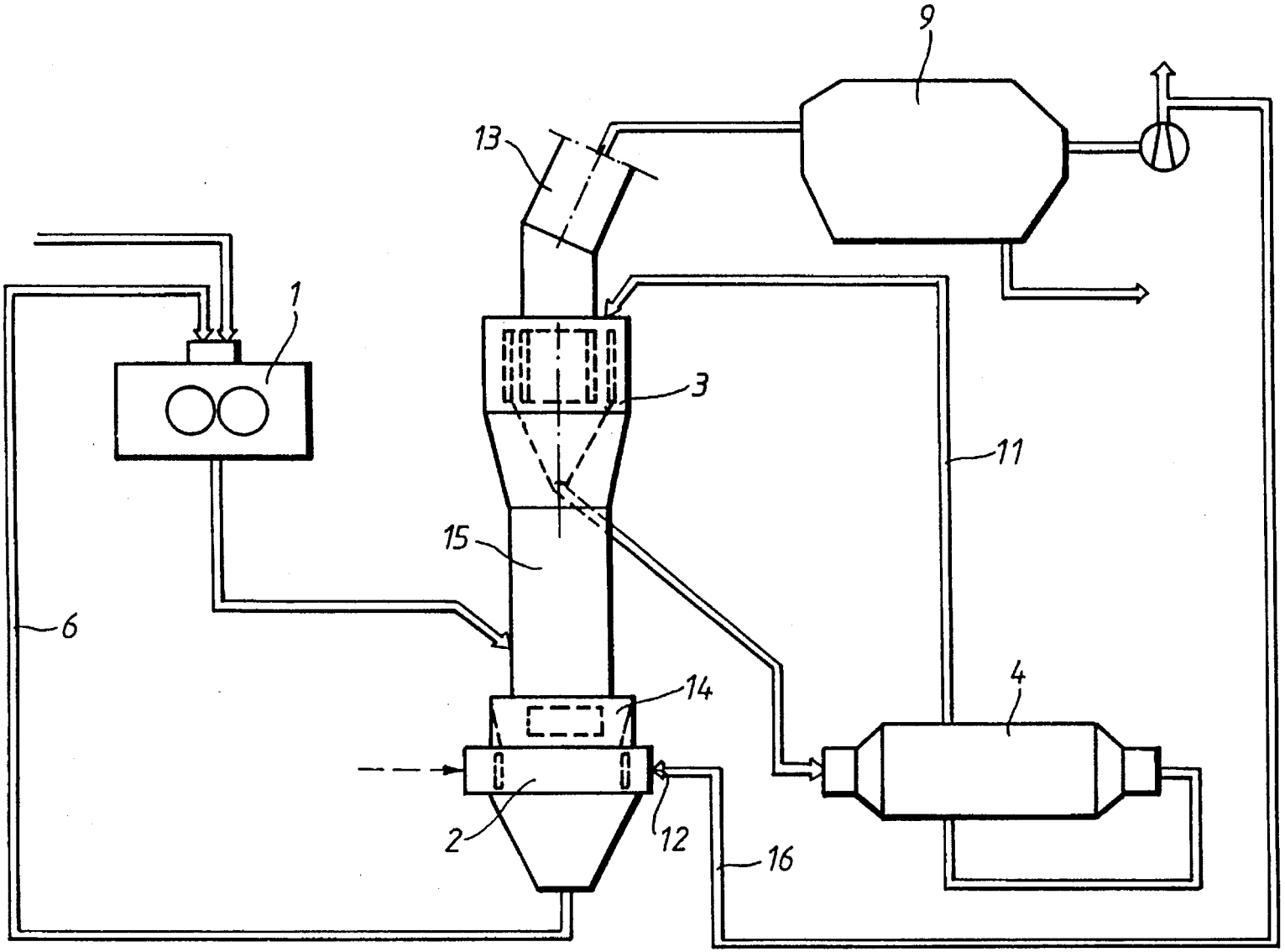

In the third embodiment shown in FIG. 3, the same reference numerals are again used for the same parts as in the first two embodiments.

This embodiment differs from the first embodiment in that the second classifier 3 is arranged above the first classifier 2.

The material crushed in the primary mill 1 passes by way of the disagglomerator 14 into the first classifier 2 which is constructed as a static classifier. Whereas the coarser fraction is returned to the primary mill 1 by way of the elevator 6, the fresh air or hot gases delivered by way of the duct 16 convey the finer fraction by way of the uptake pipe 15 into the second classifier 3 which is constructed as a dynamic classifier.

The coarse material from the second classifier 3 then passes into the fine grinding mill 4 and from there is transported mechanically by way of the conveyor arrangement 11 back to the second classifier 8 where it is fed onto the overhead distributor plate.

This grinding plant is also distinguished by a favourable energy consumption.

We claim:

1. Method of grinding and classifying brittle material for grinding comprising the steps of:

a) crushing the material in a primary mill;

b) feeding the crushed material to a first classifier and classifying the crushed material into relatively coarser and finer fractions;

c) returning the coarser fraction of the crushed material back to the primary mill and passing the finer fraction of crushed material into a second classifier and further separating the finer fraction into fine material and coarse material;

d) delivering the coarse material to a fine grinding mill and grinding the coarse material;

e) mechanically conveying the material ground in the fine grinding mill back to the second classifier for further separation; and f) passing a stream of air consecutively through the first and second classifiers, wherein the entire air stream passing through the second classifier originates from the first classifier.

2. Grinding plant comprising:

a) a primary mill for crushing brittle material for grinding;

b) a first classifier downstream of the primary mill for classifying the material crushed in the primary mill into a coarser fraction and a relatively finer fraction;

c) a second classifier downstream of the first classifier for classifying at least the finer fraction from the first classifier further into coarse material and fine material;

d) a fine grinding mill downstream of the second classifier for grinding the coarse material from the second classifier;

e) a mechanical conveyor device connecting the fine grinding mill and the second classifier for mechanically returning the material ground in the fine grinding mill back to the second classifier; and f) an air inlet connection arranged on the first classifier and an exhaust air connection arranged on the second classifier wherein the entire quantity of air passing through the second classifier flows initially through the first classifier.

3. Grinding plant as claimed in claim 2, including a disagglomerator arranged upstream of the first classifier.

4. Grinding plant as claimed in claim 2, wherein the conveyor device comprises an elevator.

5. Grinding plant as claimed in claim 2, wherein at least the second classifier comprises a dynamic air classifier.

6. Grinding plant as claimed in claim 2, wherein said first and second classifiers are arranged substantially side by side.

7. Grinding plant as claimed in any one of claims 2 to 6, wherein the first classifier is arranged above the primary mill and the second classifier is arranged above the fine grinding mill.

8. Grinding plant as claimed in any one of claims 2 to 6, wherein the second classifier is arranged above the first classifer.

9. Grinding plant as claimed in claim 2 wherein the first classifier comprises a static air classifier.

* * * * *

UNITED STATES PATENT AND TRADEMARK OFFICE

CERTIFICATE OF CORRECTION

PATENT NO. : 5,462,234

DATED : October 31, 1995

INVENTOR(S) : Norbert Patzelt et al.

It is certified that error appears in the above-indentified patent and that said Letters Patent is hereby corrected as shown below:

Column 1, in each of lines 15 and 16, change "coatset" to -- coarser --; between lines 27 and 30, insert the following paragraph: -- The object of the invention, therefore, is to improve the grinding plant and the method of grinding and classifying in terms of the energy consumption. --; line 50, change "spat tally" to -- spatially --; line 56, after "greater" insert -- detail on the basis of the drawings and the description of --; line 62, after "of" insert -- a --.

Column 2, line 9, change "I" to -- 1 --; line 18, change "8" to -- 3 --.

Column 3, line 6, change "8" to -- 3 --.

Signed and Sealed this

Thirtieth Day of January, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,462,234
DATED : October 31, 1995
INVENTOR(S) : Norbert Patzelt et al.

It is certified that error appears in the above-indentified patent and that said Letters Patent is hereby corrected as shown below:

Change the date of the Foreign Application Priority Data to -- Jun. 17, 1993 --.

Signed and Sealed this

Nineteenth Day of March, 1996

*Attest:*

Bruce Lehman

BRUCE LEHMAN

*Attesting Officer*

*Commissioner of Patents and Trademarks*